United States Patent [19]

Corbley

[11] 4,039,893

[45] Aug. 2, 1977

[54] DISCHARGE LAMP HAVING DISCONNECT EFFECTIVE UPON JACKET FAILURE

[75] Inventor: Eugene K. Corbley, Cleveland Hts., Ohio

[73] Assignee: General Electric Company, Schenectady, N.Y.

[21] Appl. No.: 669,289

[22] Filed: Mar. 22, 1976

[51] Int. Cl.[2] ..... H01J 7/14; H01J 13/46; H01J 17/34; H01K 1/62

[52] U.S. Cl. ..... 315/73; 315/85; 315/107; 315/119; 315/127

[58] Field of Search ..... 315/73, 74, 75, 107, 315/85, 119, 127, 47

[56] References Cited

FOREIGN PATENT DOCUMENTS 697,096 9/1953 United Kingdom ..... 315/119

267,753 4/1970 U.S.S.R. ..... 315/74

*Primary Examiner*—Saxfield Chatmon, Jr.

*Attorney, Agent, or Firm*—Ernest W. Legree; Lawrence R. Kempton; Frank L. Neuhauser

[57] ABSTRACT

The inner arc tube of some jacketed discharge lamps transmits ultraviolet radiation which is normally intercepted by the glass outer envelope. To prevent harmful release of such radiation in the event the outer envelope should be shattered, a mechanical disconnect is provided in the interenvelope space comprising separable conductors which are part of the arc tube supporting frame and which are maintained in engagement by the outer envelope. Upon fracture of the outer envelope, spring pressure forces the conductors apart whereupon the circuit is opened and the arc tube is disabled.

3 Claims, 2 Drawing Figures

DISCHARGE LAMP HAVING DISCONNECT EFFECTIVE UPON JACKET FAILURE

The invention relates to jacketed discharge lamps of the kind wherein the inner arc tube transmits ultraviolet radiation which is normally absorbed by the glass outer jacket.

BACKGROUND OF THE INVENTION

Some common types of high intensity discharge lamps used for general lighting comprise a quartz or fused silica arc tube enclosed within a glass outer jacket fitted with a screw base at one end. In high pressure mercury vapor lamps the arc tube contains a filling of mercury, whereas in high pressure metal halide lamps, the arc tube contains a filling of mercury and metal halides. In both kinds, the arc tube transmits ultraviolet radiation which is harmlessly absorbed by the glass outer envelope, or even gainfully absorbed by a phosphor coating on the outer envelope.

Most commonly the outer envelope remains intact to the end, and lamp life is ended by other factors. However it does happen occasionally that the outer envelope or glass jacket is shattered and the arc tube remains intact so that the lamp continues to operate. In this mode of operation, the ultraviolet radiation from the arc tube is not intercepted and may create a safety hazard.

A solution proposed to this problem by my application Ser. No. 601,858, filed Aug. 4, 1975, now U.S. Pat. No. 4,013,919, titled "Discharge Lamp Having Fuse-Switch Guard Against Jacket Failure" and assigned like this application, comprises a fuse located in the outer envelope which is connected in series with the arc tube and shunted by a thermal switch. In normal operation the switch is maintained closed by heat from the arc tube and prevents waste of energy in the fuse. Failure of the jacket while the lamp is on allows air to enter and cool the switch so that is opens. Lamp current is then drawn through the heater which rapidly oxidizes and opens the circuit, thereby disabling the lamp. While this arrangement is effective and achieves its intended purpose, a more economical solution is desired.

SUMMARY OF THE INVENTION

The object of the invention is to provide a jacketed discharge lamp which includes means for mechanically disconnecting the arc tube in the event of outer envelope fracture, such means serving to guard against accidental release of ultraviolet radiation.

A jacketed discharge lamp embodying my invention includes a mechanical disconnect comprising a pair of separable conductors which are maintained in engagement by a restraint imposed by the outer envelope and provide circuit continuity from one of the current inleads into the outer envelope to an electrode of the arc tube. In a preferred embodiment, the disconnect comprises a support rod which makes a sliding engagement with one of the current inleads into the outer envelope. The support rod extends to an anchoring dimple at the dome end of the outer envelope and also serves as a current conductor to the electrode at the distal end of the arc tube. A spring urges the support rod in the distal direction, that is, towards the dimple and out of engagement with the current inlead, but the outer envelope restrains it. Upon fracture of the outer envelope, the support rod slides forward out of engagement with the current inlead so that the circuit is opened and the arc tube is disabled.

DESCRIPTION OF PREFERRED EMBODIMENT

Figure 1:
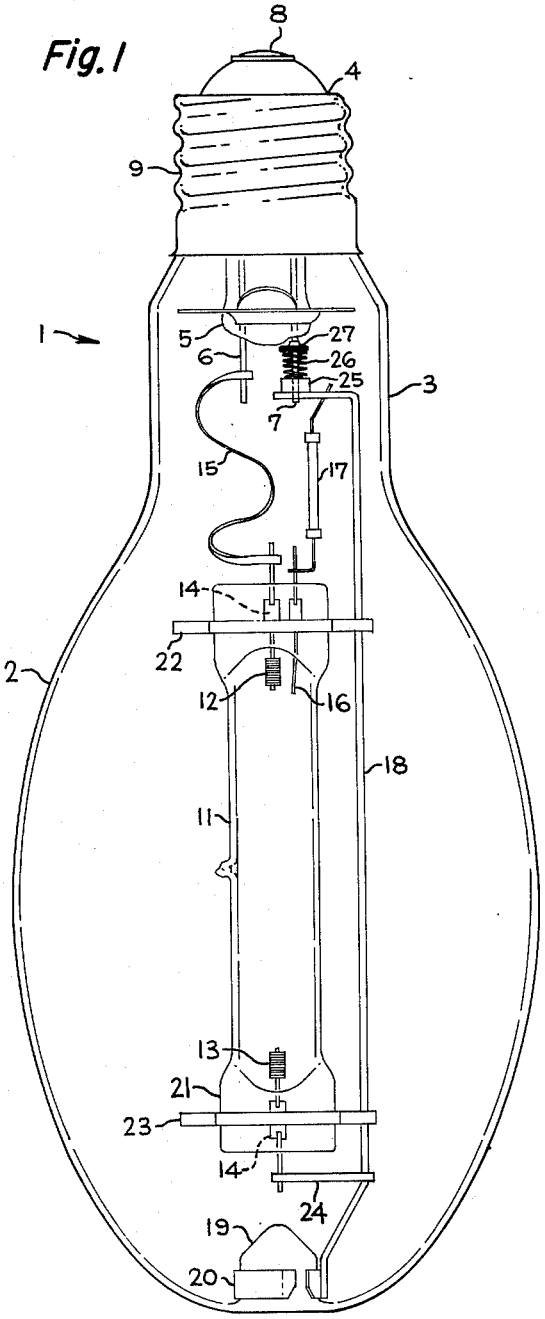
FIG. 1 shows a high pressure metal vapor lamp embodying the invention.

Referring to the drawing and more particularly to FIG. 1, there is shown a high pressure mercury vapor lamp 1 embodying the invention in preferred form. It comprises a glass outer envelope or jacket 2 of ellipsoidal shape having a neck 3 to the end of which is attached a screw type base 4. The neck 3 is closed by a re-entrant stem 5 having a press portion through which extend relatively stiff current inlead wires 6,7. The current inleads are connected exteriorly to the contact surfaces of the base, namely the insulated center contact or eyelet 8 and the base shell 9.

Inner arc tube 11 is made of fused silica, commonly referred to as quartz, and encloses a charge of mercury and an inert starting gas, suitably argon at a pressure of about 20 torr. In a metal halide lamp, the filling would include additionally small quantities of one or more metallic halides, for instance sodium and scandium iodides. The arc tube is provided at opposite ends with a pair of main discharge supporting electrodes 12,13 to which connections are made by ribbon type inleads 14 sealed through the flattened ends of the tube. Main electrode 12 is connected by a flexible ribbon 15 to current inlead 6 of the outer envelope; ribbon 15 is made longer than necessary and the excess formed into a loop. A fine tungsten wire 16 sealed into the arc tube at the stem end serves as an auxiliary starting electrode and is connected through a current limiting resistor 17 to inlead 7 by way of support rod 18, generally termed a side rod. The side rod starts at inlead 7 at the base or stem end of the outer envelope and extends to an anchoring dimple 19 at the dome end which it engages by an encircling clip 20. The arc tube is attached to the mount frame comprising the side rod by clamping its flat ends 21 between strap clips 22,23 which are welded to side rod 18. The inlead of electrode 13 is connected by conductor 24 to side rod 18 and thereby to current inlead 7.

The arc discharge through mercury vapor at a pressure exceeding one atmosphere generates both visible and ultraviolet radiation which is transmitted by fused silica arc tube 11. However, outer envelope 2 is of glass which does not transmit ultraviolet radiation. When the outer envelope is clear, the ultraviolet radiation is merely harmlessly absorbed. In so-called deluxe mercury lamps, the outer envelope is coated internally with a phosphor layer and in such case the ultraviolet radiation is absorbed and converted into visible light including red which improves the color rendition of the lamp. The space within outer envelope 2 may be either evacuated or filled with an inactive gas such as nitrogen.

It is possible for the jacket to be broken away and the arc tube to remain intact. For instance when a conventional lamp is operated base-up, it happens occasionally that the jacket upon being struck by a ball or projectile shatters and falls off without breaking the arc tube or the connections thereto. The lamp may continue to operate in this fashion until the inleads to the arc tube are oxidized and burned through. This may take several hours and in the meantime the ultraviolet radiation from the arc tube is freely radiated and may create a safety hazard.

Our invention eliminates the foregoing possibility by providing a mechanical disconnect in the inter-envelope space. Side rod 18 has a coupling 25 fastened to its root end, suitably by spot welding. The coupling makes a sliding fit on current inlead 7. A helical spring 26 encircling inlead 7 is compressed between washer 27 spot welded to the inlead next to the stem and the coupling. The spring assures positive contact at all times between inlead 7 and side rod 18, and also urges the side rod in a distal direction, that is toward dimple 19. However the outer envelope prevents any displacement and maintains the rod and its coupling 25 in engagement with current inlead 7, as illustrated in FIG. 1.

Figure 2:
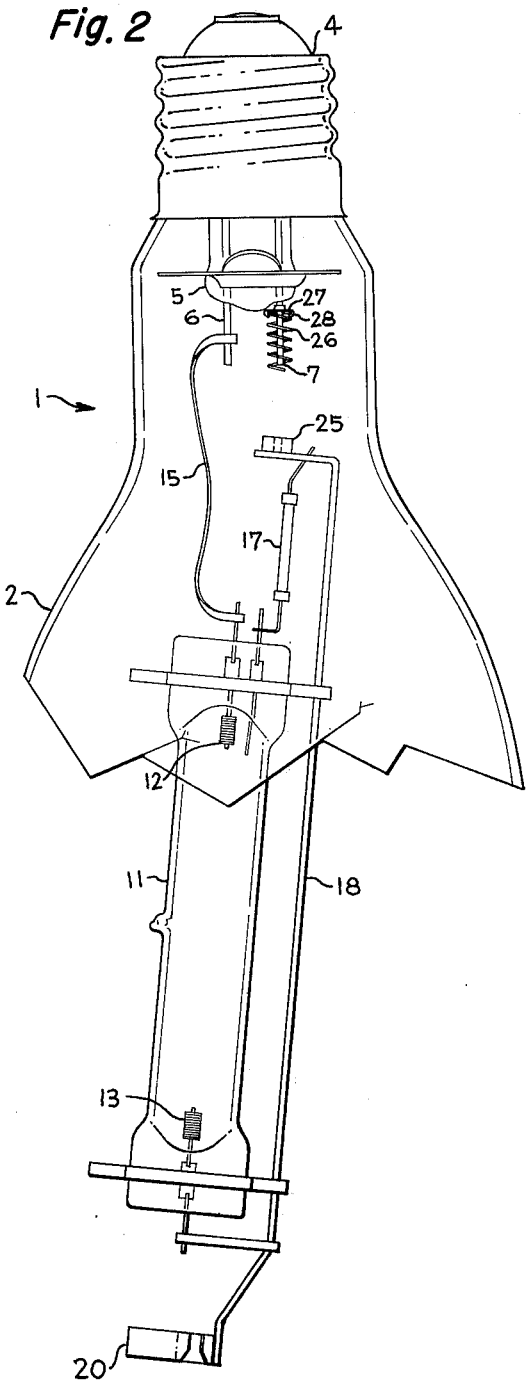
FIG. 2 is a pictorial detail showing the mechanical disconnect opened upon outer envelope fracture.

Should the jacket or outer envelope be shattered, side rod 18 is no longer restrained. Spring 26 now expands, and pushes coupling 25 out of engagement with current inlead 7 whereupon rod 18 swings clear and the mount and arc tube assembly hang only by ribbon 15 from current inlead 6, as illustrated in FIG. 2. Thus the circuit is opened and the arc tube is disabled immediately. Ribbon 15 prevents the mount and arc tube assembly from dropping from the fixture and creating a hazard. With the lamp mounted base-up as indicated, the weight of the arc tube and mount assembly might be sufficient to cause coupling 25 to slide out of engagement with current inlead 7 but spring 26 is desirable for reliability. The spring is attached at 28 to the washer and its expansion does not extend it much beyond inlead 7 so that any possibility of contact with side rod 18 after the envelope is shattered, is avoided.

What I claim as new and desire to secure by Letters Patent of the United States:

1. A jacketed electric lamp comprising: a sealed vitreous outer envelope having a neck end to which a base is attached and a dome end;

current inleads connected to said base and sealed into said envelope through the neck end;

an inner arc tube of material which transmits ultraviolet radiation supported within said outer envelope by a mount frame;

said arc tube having electrodes and inleads thereto sealed into its ends and containing an ionizable medium productive of radiation including ultraviolet which is normally intercepted at the outer envelope;

and means connecting the electrodes of the arc tube to said current inleads and including a disconnect feature, said means comprising a side-rod forming part of said frame and having a sliding coupling to one of said current inleads, said coupling being maintained in engagement by the restraint provided to said side-rod by said outer envelope, but moving out of engagement under press of gravity upon shattering of said outer envelope whereby to disable said arc tube.

2. A lamp as in claim 1 wherein said side-rod extends toward and engages the dome end of said outer envelope and is restrained thereby in engagement with said inlead, and said means include a spring at said coupling urging the side-rod out of engagement with said current inlead.

3. A lamp as in claim 1 wherein said means include a spring at said coupling urging it out of engagement with said current inlead, and said side-rod extends from the sliding coupling engaging the current inlead at the neck end of said outer envelope to an anchoring dimple at the dome end which serves as a restraint preventing the coupling from sliding out of engagement with the current inlead unless the outer envelope is shattered.

* * * * *